US005826411A

United States Patent [19]

Butturini

[11] Patent Number: 5,826,411

[45] Date of Patent: Oct. 27, 1998

[54] PACKAGING MACHINE FOR PACKAGING DIFFERENT PRODUCTS WITH HEAT-SHRINKING PLASTIC FILM

[75] Inventor: Luciano Butturini, Parabiago, Italy

[73] Assignee: Italdibipack S.p.A., Milan, Italy

[21] Appl. No.: 798,101

[22] Filed: Feb. 12, 1997

[30] Foreign Application Priority Data

Feb. 13, 1996 [IT] Italy ..... MI96A0265

[51] Int. Cl.[6] ..... B65B 53/02

[52] U.S. Cl. ..... 53/557; 53/568

[58] Field of Search ..... 53/427, 442, 557, 53/568

[56] References Cited

U.S. PATENT DOCUMENTS

| | | | |
|---|---|---|---|
| 3,696,580 | 10/1972 | Saltzer | 53/442 |
| 3,994,114 | 11/1976 | Nishimura | 53/442 |
| 4,724,652 | 2/1988 | Birkenfeld | 53/557 X |
| 4,783,950 | 11/1988 | Santagati | 53/442 X |

FOREIGN PATENT DOCUMENTS

| | | | |
|---|---|---|---|
| 756690 | 3/1971 | Belgium | 53/442 |
| 0 111 369 | 6/1984 | European Pat. Off. . | |
| 151364 | 8/1985 | European Pat. Off. | 53/557 |
| 35 40 403 | 5/1987 | Germany . | |

*Primary Examiner*—Linda Johnson

*Attorney, Agent, or Firm*—Oblon, Spivak, McClelland, Maier & Neustadt, P.C.

[57] ABSTRACT

A packaging machine for packaging different products with heat-shrinking plastic film (13) comprises means for cutting and sealing the film and a tunnel to cause the sealed film wrap applied to the product to be packaged to undergo heat-shrinking. Said cutting/sealing means are installed between a first conveyor means for product entry and a second conveyor means which receives said product. Said heat-shrinking tunnel is positioned under said first conveyor means and through said tunnel a third conveyor means is installed for driving the packaged product to exit the packaging machine. Said second conveyor means can be vertically moved from a first, raised position in which said second conveyor means is co-planar with the first conveyor means to a second, lowered position, in which said third conveyor means (17) is co-planar with the third conveyor means.

1 Claim, 3 Drawing Sheets

Fig.5
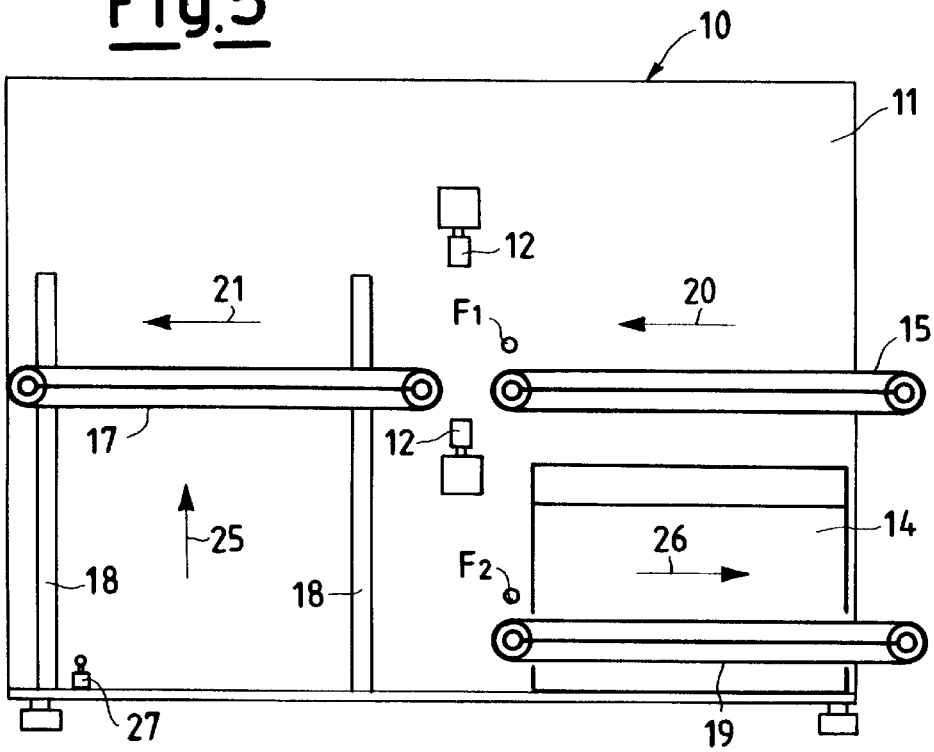
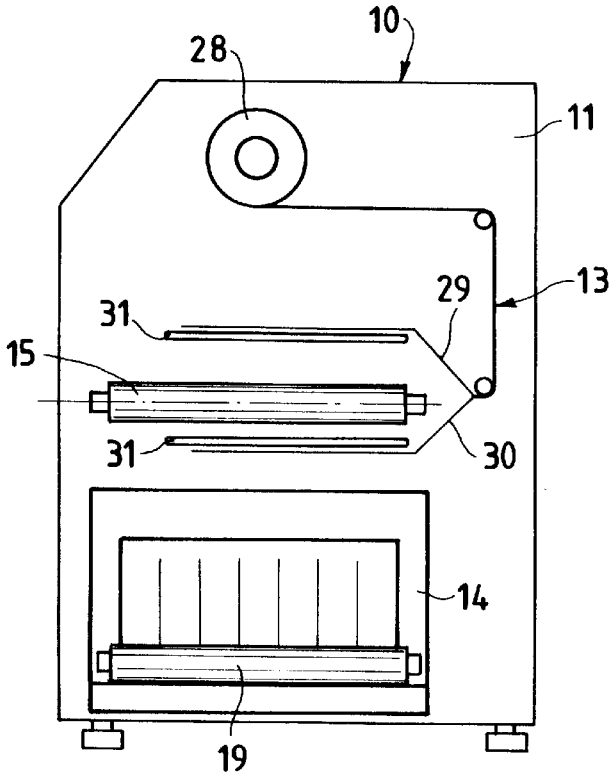
Fig.6

PACKAGING MACHINE FOR PACKAGING DIFFERENT PRODUCTS WITH HEAT-SHRINKING PLASTIC FILM

BACKGROUND OF THE INVENTION

The present invention relates to a packaging machine for packaging different products inside single-folded heat-shrinking plastic film.

Those skilled in the art are very familiar with the techniques for packaging different products inside wraps of single-folded plastic film.

A first packaging system of such a type consists in forming an envelope containing the product to be packaged by cutting and sealing both open sides of a single-folded film by means of a cutting/sealing device constituted by a frame with mutually opposite bars through which low-voltage current flows.

The so-obtained envelope is then caused to run through a tunnel the inside of which, by means of forced hot air circulation, the plastic film is caused to heat-shrink onto the product to be packaged.

These systems are suitable for continuous packaging processes capable of supplying a satisfactory throughput (number of packaged items per hour), but their overall dimensions in length are relatively large and require a certain investment expense by the user.

According to a second system, a machine is used in which the single-folded plastic film cutting/sealing step and the step of film heat-shrinking step on the product to be packaged, take place inside one single chamber inside which a heat source and means for hot air circulation are provided and in which inside the top portion of this chamber bars for film cutting and sealing are installed.

The chamber can be closed by means of a hinged cap cover provided with counter-bars, so as to define a single chamber for film cutting, sealing and heat shrinking.

Between the chamber and the cap cover a carrier rack is also provided for supporting the product during the packaging step.

The product to be packaged, which is placed between the film plies, is charged to said rack and lowering the cap cover down causes the cutting/sealing blades to be enabled, together with the fan for forced hot air circulation from said heating means.

A machine of this type, which, for example, is disclosed and illustrated in U.S. Pat. No. 4,104,848, is particularly suitable for batchwise productions, is compact, is relatively cheap, but has the drawback that every time the user lifts the cap cover for removing the finished package from the machine, the user comes into contact with a mass of hot air and, sometimes, also with the fumes deriving from film heat cutting/sealing step, when the bars are not perfectly clean and bar temperature is not properly adjusted.

BRIEF SUMMARY OF THE INVENTION

The general purpose of the present invention is to provide a packaging machine which offers all of the advantages of both tunnel machines and cap cover machines without the drawbacks of both of them.

The above said purpose is achieved by a machine having the characteristics exposed in the appended claims.

The structural and functional characteristics of the invention and its advantages over the prior art will be more clearly understood from a study into the following disclosure, made by referring to the accompanying drawings, which display an exemplifying embodiment of the invention.

BRIEF DESCRIPTION OF THE DRAWINGS

In the drawings:

FIGS. 1–5 show schematic front elevation views of a packaging machine realized according to the present invention and displayed in the several operating steps which compose a packaging cycle; and FIG. 6 displays the same packaging machine of FIGS. 1–5 according to a side view.

DETAILED DESCRIPTION OF THE INVENTION

Figure 1:
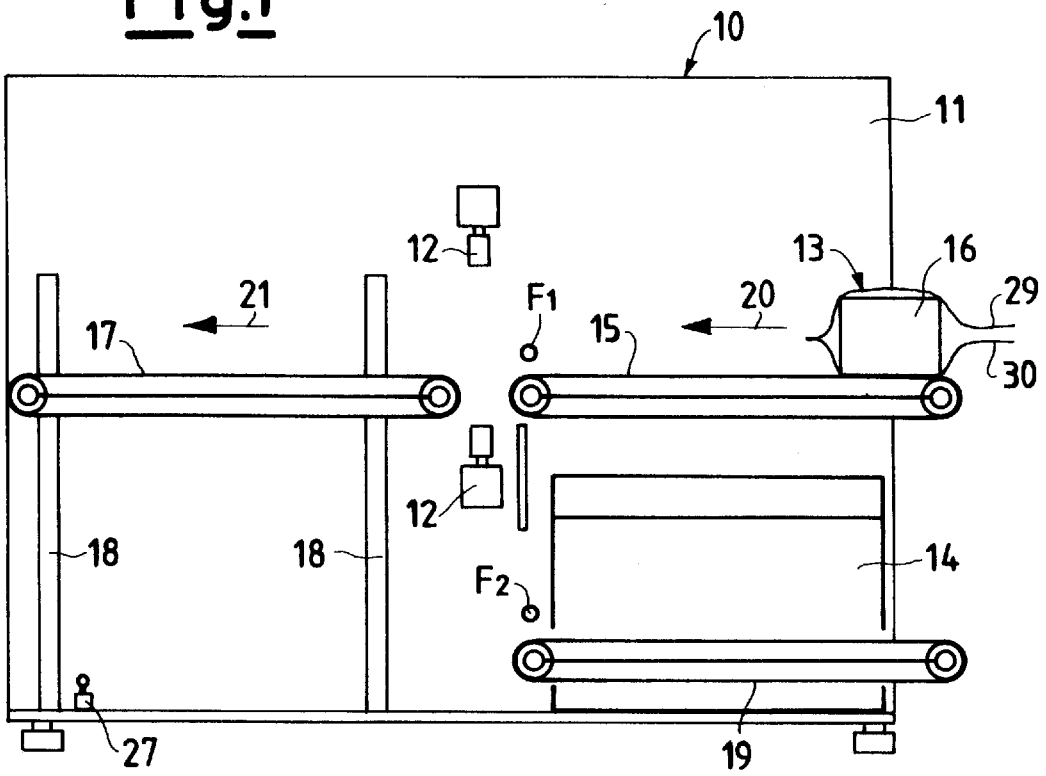

Referring to the drawings, the machine according to the present invention is generally indicated with (10) and is structurally formed by a framework (11) which supports two plastic film cutting/sealing bars (12) and a film heat-shrinking tunnel (14) inside of which air is heated and caused to forcedly circulate, in a per se known way. The plastic film and (13) is a single-folded film, is fed from a bobbin (28) and its mutually overlaying plies (29) and (30) are opened by opening means (31) of a type known to those skilled in the art (FIG. 6).

As one will clearly see from the drawings, the film cutting/sealing bars (12) are installed between a first, entry conveyor means (15) by which the product (16) to be packaged is driven to enter the machine and a second conveyor means (17), coplanar with the first one (15), which receives the product (16) packaged, i.e., wrapped by the cut and sealed film.

Figure 3:
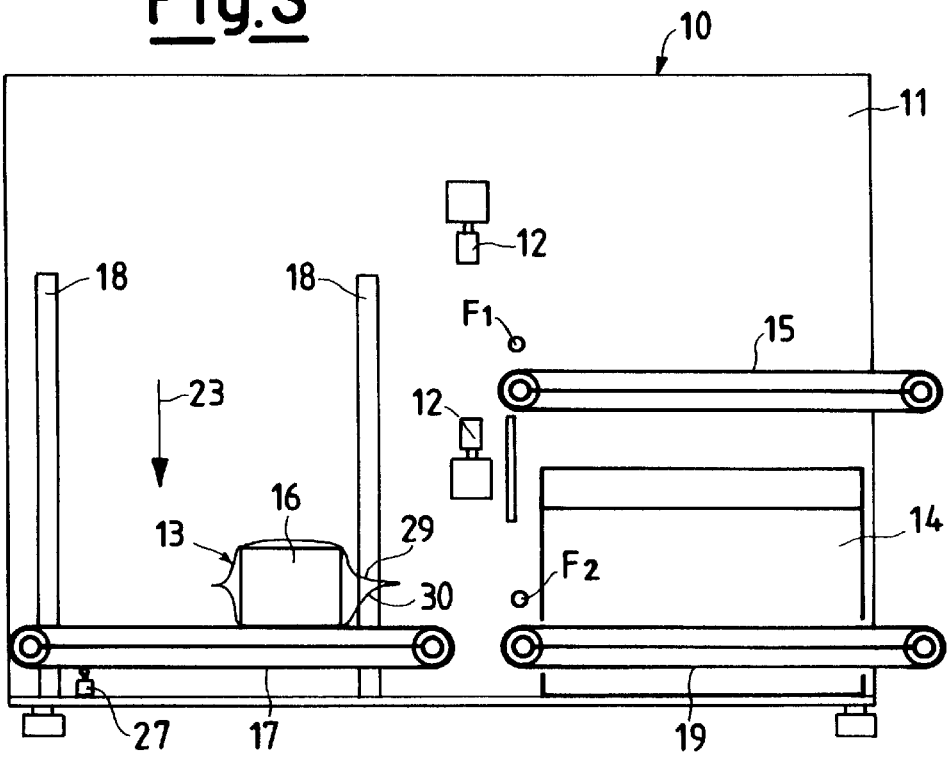
Figure 4:
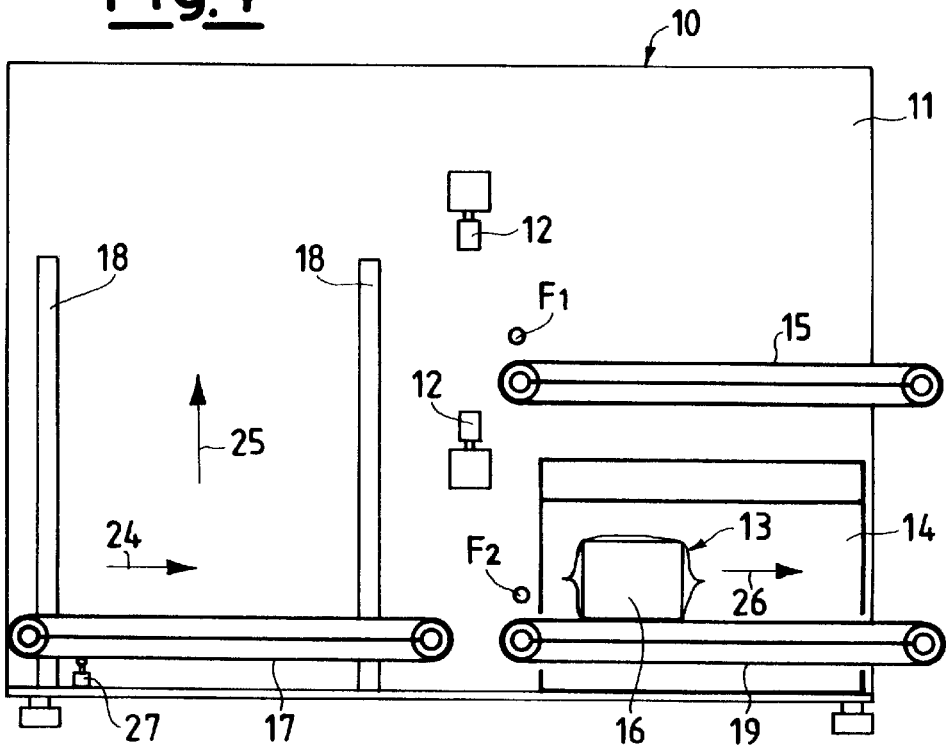

The conveyor means (17) is vertically moved (reciprocated) on guide means (18), from the raised position shown in FIG. 1, to the lowered position shown in FIGS. 3 and 4, in which said receiver conveyor means (17) is co-planar with a third, exit conveyor means (19) which drives the packaged product to exit the machine; this last conveyor means (19) runs through the heat-shrinking tunnel (14) which is arranged under the first, entry conveyor means (15).

The operation of the packaging machine according to the present invention will be clear from the above disclosure referred to the figures, and as follows.

Referring to FIG. 1, the conveyor means (15), (17) are driven to rotate in the same direction as shown by arrows (20), (21), and the product (16) to be packaged is charged to the entry conveyor means (15), which feeds it to the receiver conveyor means (17).

Figure 2:
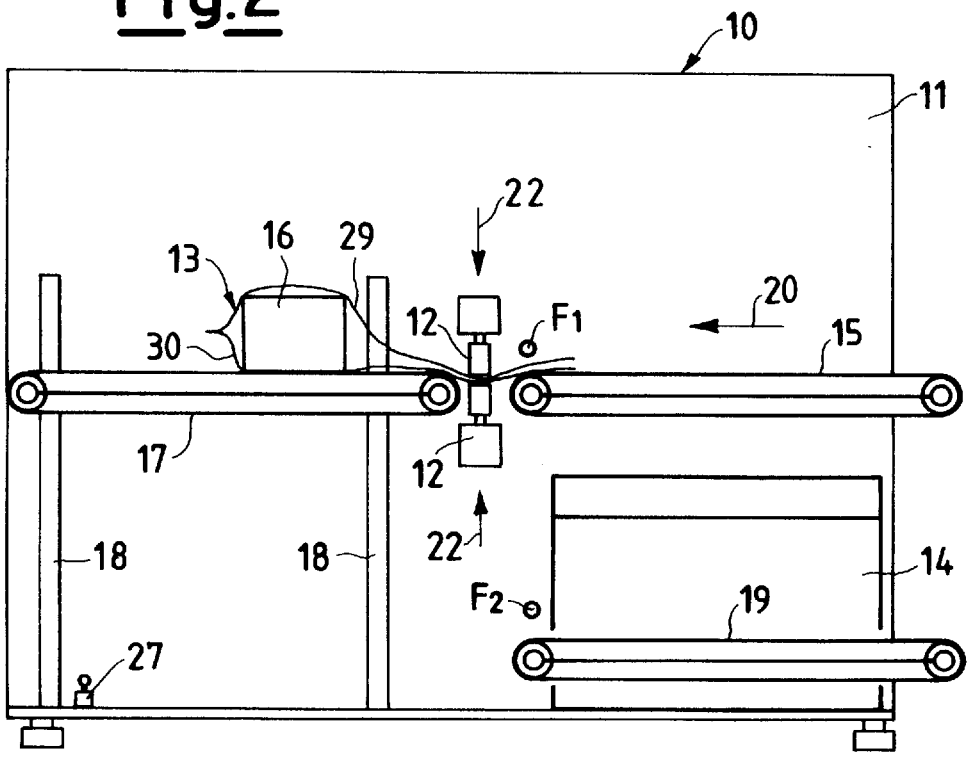

The product (16) arrives on the receiver conveyor means (17) (as shown in FIG. 2 of drawings), a system of photocells F1 detects its passage and when the same product (16) is completely placed on the receiver conveyor means (17), said photocell system stops the revolution movement of said receiver conveyor means and closes the film cutting/sealing bars (12), causing them to move towards each other, as shown by arrows (22).

Referring to FIG. 3, at the end of the step of film cutting/sealing around the product (16), the bars (12) are opened again and generate a pulse which commands the receiver conveyor means (17) to move downwards, as indicated by arrow (23), to reach that position in which it is co-planar with the exit conveyor means (19); in this position, the conveyor means (17) interacts with a microswitch (27) which causes it to start rotating (FIG. 4). Simultaneously, the rotation of the entry conveyor means (15) is stopped.

As shown in FIG. 4, at this step in the process, the receiver conveyor means (17) is caused to revolve in the direction as shown by arrow (24), thus feeding the product (16) wrapped inside the envelop of plastic film (13) to the exit conveyor means (19), which carries it through the heat-shrinking tunnel (14), by running in the direction of arrow (26). A system of photocells F2 detects the passage of the product between both conveyor means (17), (19) and when the product (16) has been completely transferred to the conveyor means (19) which runs through the heat-shrinking tunnel (14), said photocell system causes the conveyor means (17) to return, by moving according to the direction as shown by arrow (25), to the raised position of FIG. 5, also stopping its revolution movement in the direction of arrow (24).

The machine is now ready for performing a new operating cycle and when the receiver conveyor means (17) reaches its raised position, as shown in FIG. 5, coplanar with the entry conveyor means (15), a pulse command is transmitted to cause both conveyor means (15), (17) to start running again in the direction of arrows (20), (21), to start a new operating cycle.

A packaging machine is thus provided which, while having extremely compact dimensions, is capable of automatically and continuously operating, with a high throughput value.

The system of automation of the several components which constitute the machine is not illustrated in detail here, because it is within the reach of one skilled in the art.

I claim:

1. A packaging machine for packaging a product with heat-shrinking plastic film comprising:

first conveyor means for entry of said product;

means for cutting and sealing said film around said product, said cutting and sealing means receiving said product from first conveyor means and producing from said product a wrapped product;

second conveyor means for receiving said wrapped product from said cutting and sealing means.

* * * * *